US005089983A

United States Patent [19]

Chiang

[11] Patent Number: 5,089,983

[45] Date of Patent: Feb. 18, 1992

[54] CHARGE DOMAIN VECTOR-MATRIX PRODUCT PROCESSING SYSTEM

[75] Inventor: Alice M. Chiang, Weston, Mass.

[73] Assignee: Massachusetts Institute of Technology, Cambridge, Mass.

[21] Appl. No.: 473,870

[22] Filed: Feb. 2, 1990

[51] Int. Cl.[5] ..... G06G 7/16; G06J 7/12

[52] U.S. Cl. ..... 364/844; 364/841; 364/606

[58] Field of Search ..... 364/841, 844, 825, 602, 364/606; 357/24; 340/347

[56] References Cited

U.S. PATENT DOCUMENTS

| | | | |
|---|---|---|---|
| 4,156,923 | 5/1979 | Lampe et al. | 364/844 |
| 4,161,785 | 7/1979 | Gasparek | 364/844 |
| 4,316,258 | 2/1982 | Berger | 364/825 |
| 4,430,723 | 2/1984 | Tanikawa | 364/844 |
| 4,458,324 | 7/1981 | Burke et al. | 364/606 |
| 4,464,726 | 8/1984 | Chiang | 364/606 |
| 4,625,293 | 11/1986 | Vogelsong et al. | 364/841 |
| 4,811,270 | 3/1989 | Nash | 364/841 |

*Primary Examiner*—Jerry Smith
*Assistant Examiner*—Jim Trammell
*Attorney, Agent, or Firm*—Thomas J. Engellenner; Mark G. Lappin

[57] ABSTRACT

A charge domain vector-matrix product processing system. The system includes a charge coupled device tapped delay line, an array of digital parallel shift register memory devices, and a signal processor. A sampled analog signal is stored within the tapped delay line, and multiple vectors of m-bit words are stored within the digital memory device. The signal processor sucessively applies vectors from the digital memory device and charge packets from the tapped delay line to an array of digital-analog multipliers. The signal processor then sums the outputs of the digital-analog multipliers and produces an output charge packet corresponding to a respective element of the vector-matrix product.

5 Claims, 5 Drawing Sheets

CHARGE DOMAIN VECTOR-MATRIX PRODUCT PROCESSING SYSTEM

BACKGROUND OF THE INVENTION

The present invention is in the field of integrated circuit networks and more particularly is directed to charge domain parallel processing networks.

Vector-matrix product processing systems are generally known in the art. By way of example, U.S. Pat. No. 4,464,726 discloses a particularly effective form of such systems. That patent discloses a charge domain vector-matrix product system including a floating gate tapped delay line for holding and shifting analog sampled-data in the form of charge packets, and including an array (or a matrix) of charge coupled device (CCD) digital-analog multipliers, for example, in the form disclosed in the U.S. Pat. No. 4,458,324, referred to as multiplying digital-to-analog converters (MDAC's). At each stage of the delay line there is a floating-gate sensing electrode. The output of the sensing electrode is coupled to the analog input port of a corresponding CCD digital-analog multiplier. The output of each multiplier is a charge packet which is proportional to the product of the analog sampled data and a digital word.

This structure can be used to form networks adapted for performing high level mathematical operations such as vector-matrix product, i.e., $$\sum_{n=1}^{N} f_n c_{nk} = gk$$

for k=1, 2 . . . K.

In the disclosure of U.S. Pat. No. 4,464,726, the digital words $c_{nk}$ for the MDAC's (i.e., the matrix values) are provided by an N×K×M-bit, parallel-addressable, digital memory, which may be on-chip or off-chip, and may be CCD or ROM, in either volatile or non-volatile form.

Such vector-matrix product networks may be configured to perform functions such as discrete fourier transforms (DFT). In alternate configurations, the network may eliminate scanning round clutter from an aircraft surveillance radar by performing as an optimal moving target indicator (MTI) filter bank. In yet other configurations, the network may function as a matched filter bank for applications such as the Global Positioning System (GPS).

An important limitation for the prior art charge domain vector-matrix product processing systems is that only a single set of matrix values may be readily stored and be readily accessible for the system, although that storage is programmable (an important advantage) to permit re-programming after a product operation with a different set of matrix values. As a result of this limitation, certain applications which require a rapid succession of vector-matrix product computations must use multiple networks, operating in parallel, each performing a single vector-matrix product computation. Alternatively, the time required for such operations is limited by the loading (i.e., programming) time for the matrix values.

It is an object of the present invention to provide an improved charge domain parallel processing network.

It is another object to provide an improved charge domain vector-matrix product processing system.

Another object is to provide a vector-matrix product processing system adapted to perform rapid successive vector-matrix product computations.

SUMMARY OF THE INVENTION

The present invention is an improved charge domain vector-matrix product network for generating the signals representative of the product of an N-element vector and an N×K element matrix. The network includes a charge coupled device (CCD) N-stage tapped delay line, an N×K M-bit digital parallel shift register memory device, N M-bit charge domain digital-analog multipliers, a charge summing device and a controller. In the preferred form of the invention, the shift register memory device is a charge domain device, but in other forms of the invention, different types may be used, such as CMOS.

The tapped delay line is adapted to establish a succession of N charge packets therein in response to a succession of N applied input signals, where each packet has a magnitude corresponding to one of the element of the vector. In the delay line, the charge packets are shifted from stage-to-stage along said delay line as the vector data is applied to the product network. The delay line includes N floating gate sensing electrodes, each overlying one of the stages of the line and being adapted to provide a potential representative of the magnitude of a charge package currently within the underlying stage. The digital parallel shift register memory device is adapted to storing N×K M-bit words, where each of the words is representative of the value of a corresponding element of the matrix. In the preferred form, the shift register memory device includes K stages in a stack configuration, each stage being adapted to store N M-bit words. The shift register memory device is responsive to an applied shift signal to selectively shifting the stored words from stage-to-stage from the input stage to the output stage of the stack.

The digital-analog multipliers each an analog input port and a digital input port, and provide a charge packet having a magnitude proportional to the product of a potential applied to the analog input port and an M-bit digital signal applied to the digital input port. The analog input port of each of multiplier is coupled to an associated sensing electrode of the delay line, and the digital input port of each multiplier is coupled to an associated M-bit portion of the output stage of the shift register memory device.

The controller successively applies N words of the memory device at a time to the respective digital input ports of the multipliers, where each set of N words includes the words representative of the values of one of the rows of the matrix. In the preferred form of the invention, the controller generates the shift signals and applies those shift signals to the shift register memory device so that said N words are shifted from stage-to-stage. In some forms of the invention, the shift register stack is arranged to recirculate the stored data, thereby providing a re-fresh feature.

The charge summing device is operative for each set of N words applied to the multipliers. The summing device generates an output charge packet for each set of words applied to the multipliers. The output charge packets have magnitudes proportional to the sum of the magnitude of the charge packets generated by said multipliers for each set, so that the magnitude of the respective output charge packets correspond to the respective element of said vector-matrix product.

DESCRIPTION OF THE PREFERRED EMBODIMENT

1. Prior Art Vector-Matrix Product Device

Figure 1:
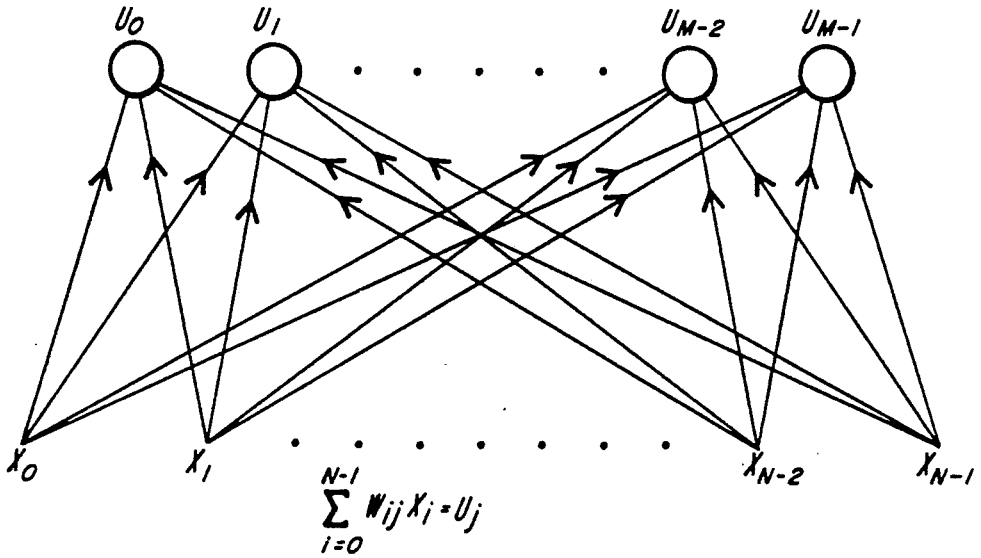
FIG. 1 shows a mathematic/schematic representation of a vector-matrix product.

FIG. 1 shows a mathematical/schematic representation of a vector-matrix product computation.

Figure 2:
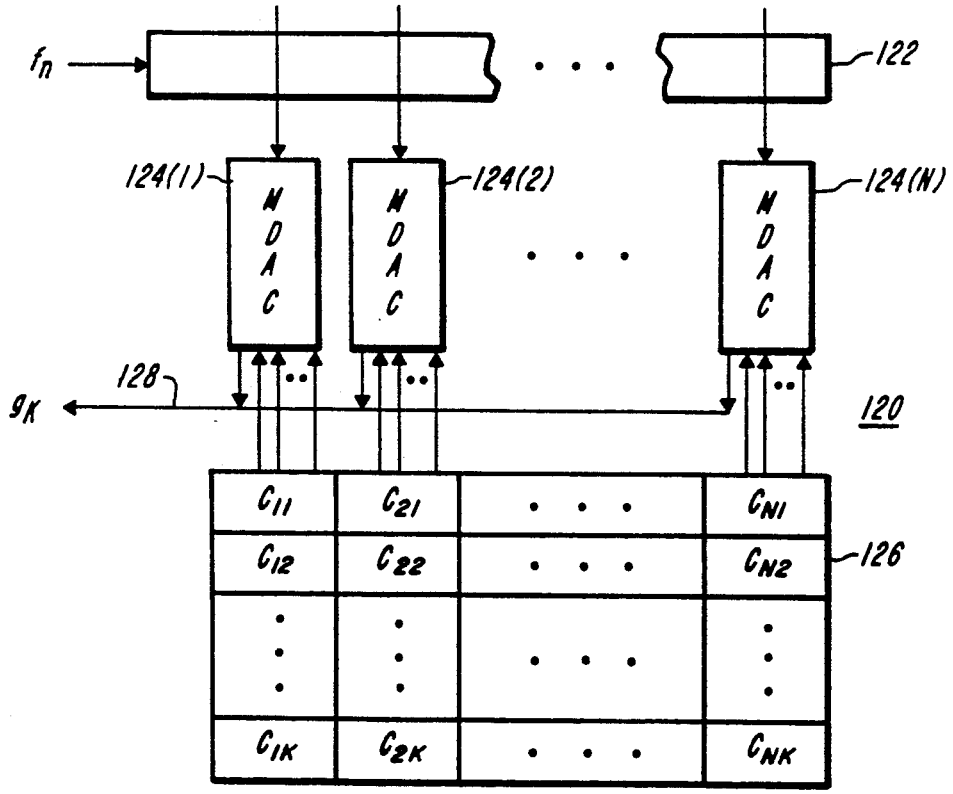
FIG. 2 (PRIOR ART)
FIG. 2 shows in schematic form an exemplary vector-matrix product network in accordance with the prior art.

FIG. 2 shows a prior art device 120 which performs the vector-matrix product computation function, i.e, $$\sum_{n=1}^{N} f_n c_{nk} = gk$$

for k=1, 2 . . . K, where $f_n$ is an analog sampled function and each element in the matrix [C] is an M-bit digital word. The device 120 is the type disclosed in U.S. Pat. No. 4,464,726. In this form, the matrix [C] is electrically programmable by the user.

The device 120 includes an N-point, floating gate, tapped delay line 122, N multiplying D-to-A converters (MDAC's) with M-bit accuracy (denoted 124(1) through 124(N)) and an N×K×M-bit, parallel-addressable, digital memory 126. The digital memory can be either on-chip or off-chip. By way of example, CCD or ROM memories can be used in either volatile or non-volatile form. The floating-gate tap outputs are coupled to the analog inputs of the corresponding MDAC's. The digital inputs of the MDAC's are controlled by the M-bit words in the respective cells of the digital memory 126. All the MDAC's have a common output 128.

Figure 2A:
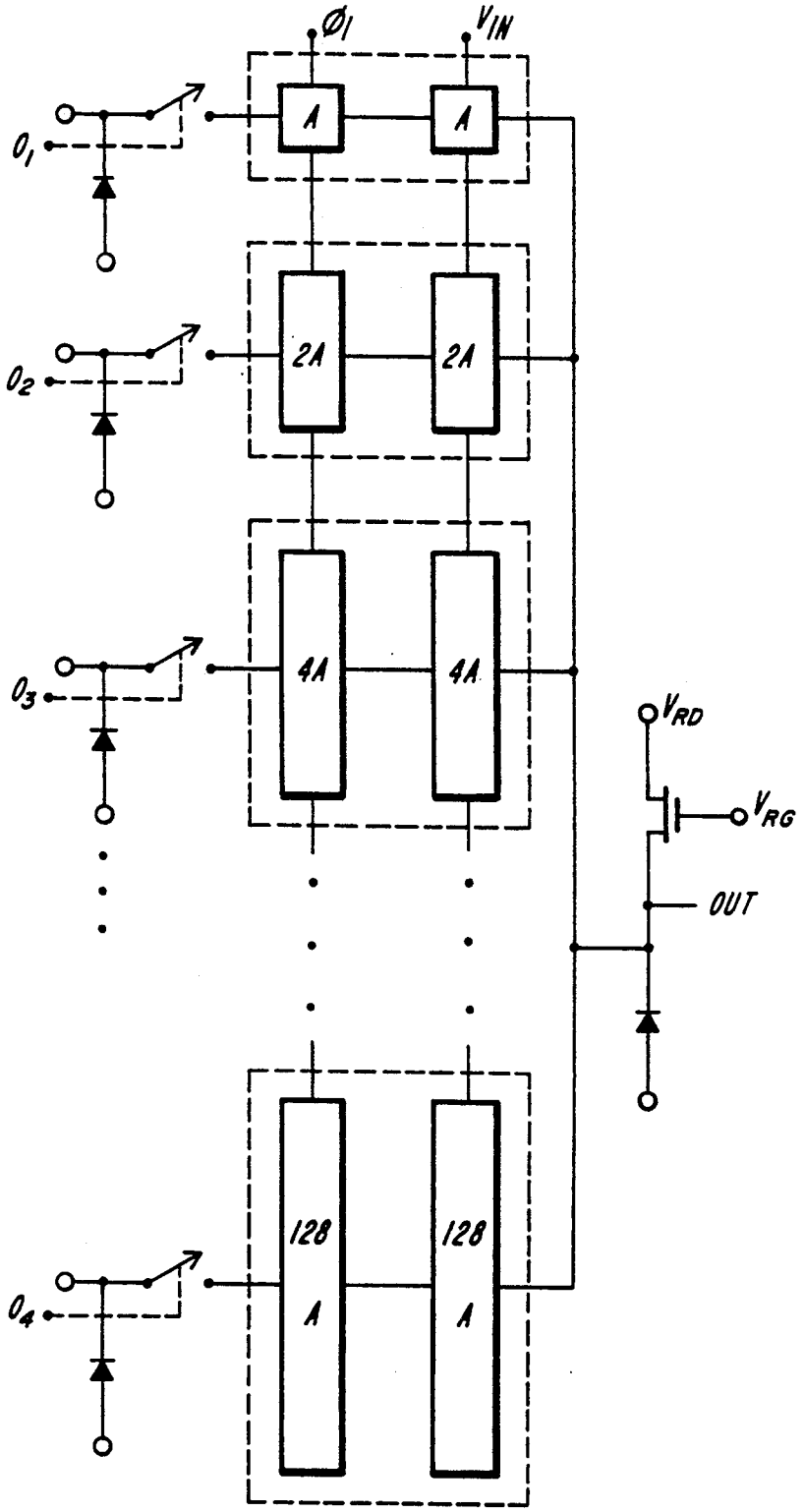
FIG. 2A (PRIOR ART)
FIG. 2A shows in schematic form an exemplary multiplying D-to-A converter in accordance with the prior art.

By way of example, the MDAC's can have the general form shown (for an 8-bit configuration) in FIG. 2A, as described in detail in U.S. Pat. Nos. 4,464,726 and 4,458,324.

In operation, the memory 126 is initially loaded with values $c_{nk}$. Then, the analog vector function $f_n$'s are serially loaded into the CCD tapped delay line 122. The CCD delay line clock is then stopped. The floating-gate output after each stage of delay is coupled to the analog input of the corresponding MDAC's. The digital memory 122 is parallel addressable, i.e., it can be simultaneously accessed in serial to all the columns. After time $T_c$, the memory output is the first row of the matrix C (i.e., $c_{11}$, $c_{21}$, . . . $c_{N1}$), and each element is an M-bit word. These digital words are applied to the digital input port of the corresponding MDAC's. The summed output from all the MDAC's is $$\sum_{n=1}^{N} f_n c_{n1}$$

which is equal to g1. The second row of the digital memory (i.e., $c_{12}$, $c_{22}$, . . . $c_{N2}$) is now shifted out and the summed output from all N the MDAC's is $$\sum_{n=1}^{N} f_n c_{n2} = g2$$

In general, after the kth row of the digital memory is applied to the MDAC's, the summed output from all the MDAC's is $$\sum_{n=1}^{N} f_n c_{nk} = gk$$

In summary, as the digital memory 126 is sequentially addressed row-by-row, there are a sequence of analog output data from the MDAC's summing mode. They are $$\sum_{n=1}^{N} f_n c_{n1},\ \sum_{n=1}^{N} f_n c_{n2},\ \ldots\ \sum_{n=1}^{N} f_n c_{nk}$$

which are g1, g2, . . . gk, respectively. Therefore, the device computes the desired vector-matrix product [F][C].

Thus, the analog function $f_n$ is serially loaded into the CCD delay line. The analog sampled data is updated by one clock period, i.e. so that the stored data in the delay line are now, $f_{N+1}$, $f_N$, . . . $f_3$,$f_2$. the same multiplication process is repeated (i.e., address the digital memory K times and perform K sequential multiplication). As a result, there are a sequence of output data on the MDAC's summing mode 128 which are representative of $$\sum_{n=2}^{N+1} f_n c_{n1},\ \sum_{n=2}^{N+1} f_n c_{n2},\ \ldots\ \sum_{n=2}^{N+1} f_n c_{nk}$$

2. The Vector-Matrix Product Processing System of the Invention

The vector-matrix processor 10 of the present invention is based on a vector-matrix product computing algorithm, which can be used as a 1D correlator, a 2D matched filter, and a two-layer neural network (NN) computing module. In the preferred embodiment described below, a single chip processor 10 with 2016 programmable interconnections is disclosed based on charge-coupled (CCD) technology. At a 10-MHz clock rate, the processor 10 performs 2.8 billion arithmetic operations per second and dissipates less than 2 W. The processor architecture is flexible and modular to accommodate evolving system architectures and to allow for scale-up to a large-sized system by using many such devices in a parallel/pipeline fashion. The processors can also be used as co-processors with a conventional serial digital computer to speed up the simulation of a variety of neural network algorithms. In addition, the devices can be used as particularly efficient, economic, and effective front-end feature extraction processors in conventional image and speech signal processing systems.

The basic processor structure performs the generic weighted-sum operation required in a neural network and for computing the inner product of two matrices needed for two-dimensional spatial filtering.

Generally, the processor 10 comprises analog tapped-delay lines as input buffers, multiplying D/A converters (MDAC's) for connection weights, and on-chip memory for storing digital weights. The on-chip analog input buffer enables the various CCD modules to implement hierarchaical layered networks in a high-throughput pipelined fashion without massive I/O interconnects between modules. By using two such CCD modules and feeding the output of the first module into the second one, a two-chip set can be used to implement a three-layer net, and a three-chip set can be used to implement a four-layer net, and so forth. In addition, systems with larger interconnection between adjacent layers can be realized by using many CCD modules in a parallel fashion.

For example, the processor 10 device an be used to implement Sejnowski and Rosenberg's feed-foward NETtalk to convert English text into phonetic representation. It is important to note that not only the chip can be used in a feed-forward network, it can also be used in a feed-backward network such as a PDP net. In addition, the processor 10 with input tapped delay lines is ideally suited to implement a multilayer network for speech recognition specifically designed to detail with the dynamic nature of speech such as a Time-Delay Neural Networks, TDNN. A TDNN unit is a single-output two-layer net with input time delay units incorporated with the weighted sum operations. Each unit can effectively receive speech inputs in the adjacent time windows. Therefore, the network has the ability to relate and compare current input with the past history of events. In practice, after a "learning" phase to encode temporal relationships within the frame windows, the weights are used as a moving acoustic-phonetic feature detectors and the processor performs recognition by passing input speech through the TDNN unit.

Figure 3:
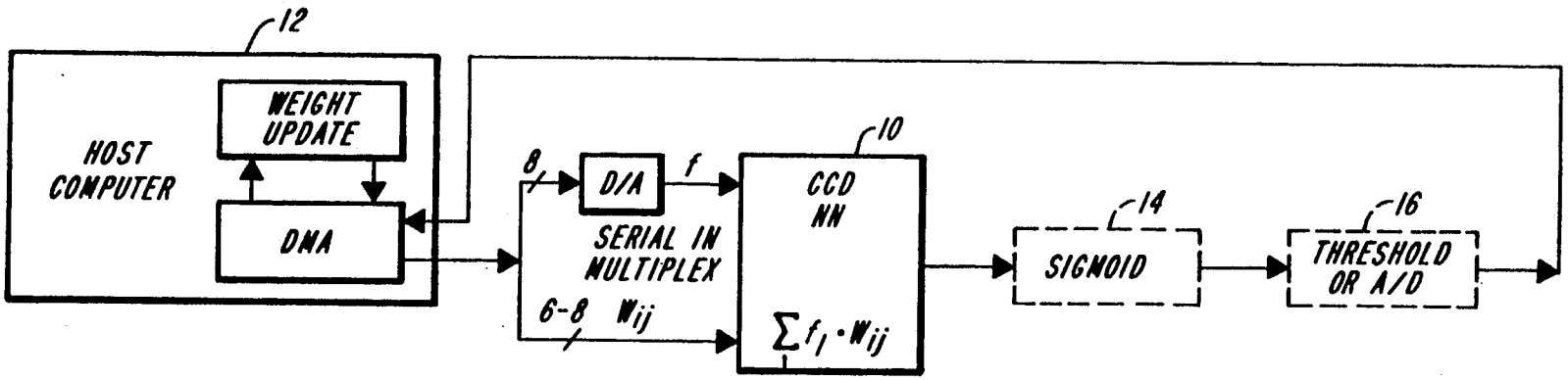
FIG. 3 shows in block diagram form a system incorporating a vector-matrix product network in accordance with the present invention.

Another advantage of having an on-chip input buffer is that it allows an analog input to multiplexed into all the input ports of the processor 10. Therefore, even though the chip may be used in a parallel system, the device can be used now as a high-speed co-processor with a conventional serial computer to speed up the simulation of various neural net algorithms, such as a multilayer perception, a Hamming net, a Kohonen net, or a parallel distributed processing model. A system architecture using this serial approach is shown in FIG. 3. In that system, a host computer 12 provides data through sigmoid block 14 and an A/D converter 16 back to computer 12.

Figure 4:
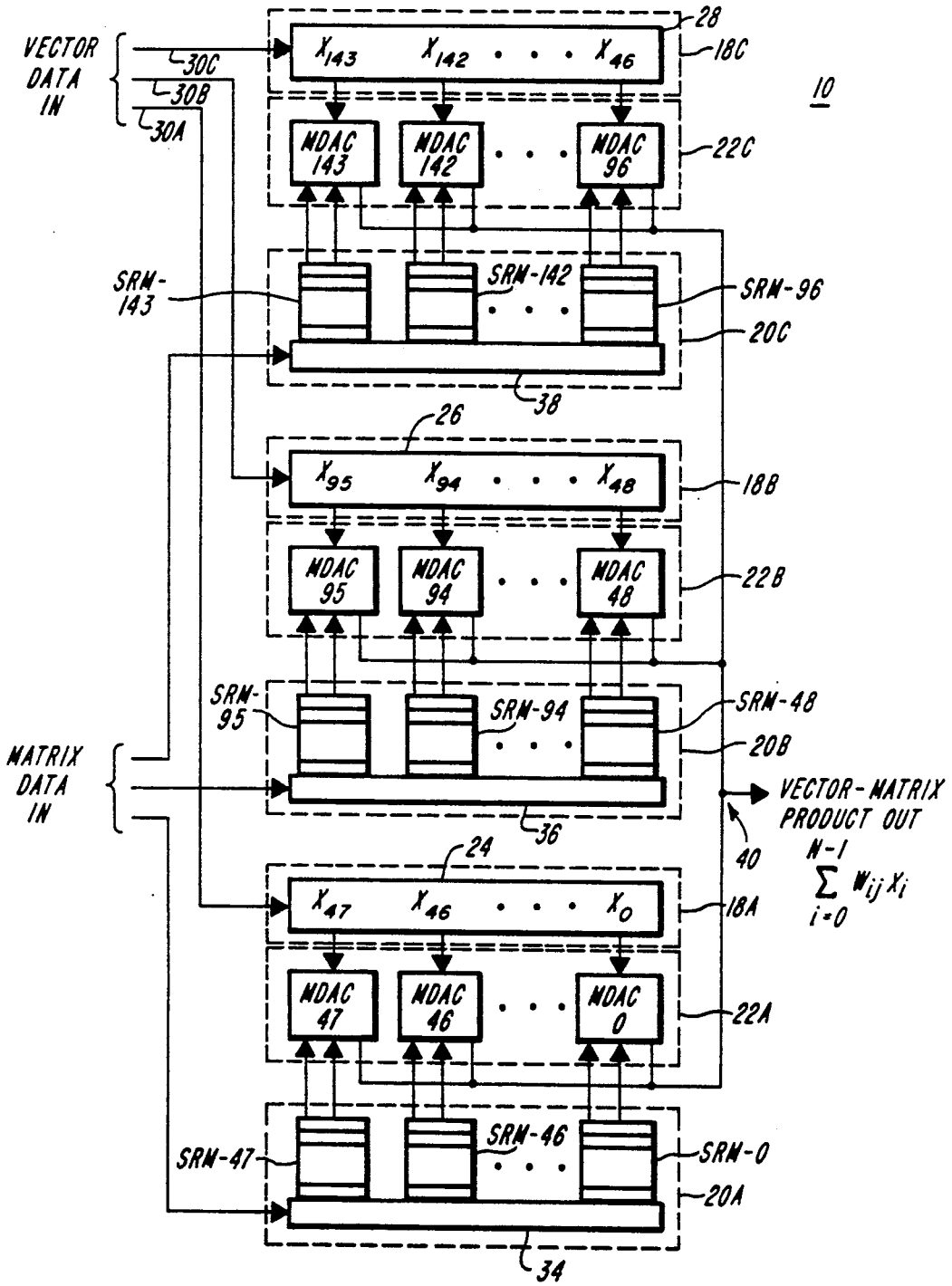
FIG. 4 shows in schematic form an exemplary vector-matrix product network in accordance with the present invention.

The exemplary processor 10 is shown in FIG. 4, and includes vector input networks (blocks 18A, 18B and 18C), matrix input networks (blocks 20A, 20B and 20C), and multiplying digital-to-analog (D-to-A) networks (blocks 22A, 22B and 22C).

The vector input networks 18A, 18B and 18C each include a 48-stage analog floating-gate tapped delay line (blocks 24, 26 and 28, respectively), for together receiving 144 analog values (vector data) in serial from input lines 30A, 30B and 30C, respectively. Delay line 24 receives input vector values denoted $x_0$ through $x_{47}$, delay line 26 receives input vector values denoted $x_{48}$ through $x_{95}$, and delay line 28 receives input vector values denoted $x_{96}$ through $x_{143}$.

The matrix input networks 20A, 20B and 20C each include 48 14-stage 6-bit digital shift register memories, with re-fresh, (blocks SRM-0 through SRM-143) and a matrix input loading network (blocks 34, 36 and 38), for together receiving and holding 14 independent sets of 144 6-bit digital weights. Shift register memories SRM-0 through SRM-47 end receive 14 sets of 6-bit input matrix values denoted $w_{0j}$ through $w_{47j}$, for j=0 through 13, shift register memories SRM-48 through SRM-95 receive input matrix values denoted $w_{48j}$ through $w_{95j}$ for j=0 through 13, and shift register memories SRM-96 through SRM-143 receive input matrix values denoted $w_{96j}$ through $w_{143j}$ for j=0 through 13.

The multiplying D-to-A networks 22A, 22B and 22C each include 48 multiplying D-to-A converters or MDAC's (blocks MDAC-0 through MDAC-143). All of MDAC-0 through MDAC-143 share a common output and are coupled to a charge domain summing device (indicated by reference designation 40).

A floating gate electrode at each stage of delay lines 24, 26 and 28 is coupled to the analog input port of the corresponding MDAC. The 6-bit outputs of the last (top of the stack as illustrated) stage of each of SRM-0 through SRM-143 are coupled to the digital weight inputs of the corresponding ones of MDAC-0 through MDAC-143. With this configuration, the output of each MDAC's provided a charge packet proportional to the product of the analog input (x) and the digital weight input (w) to that MDAC's.

Figure 5:
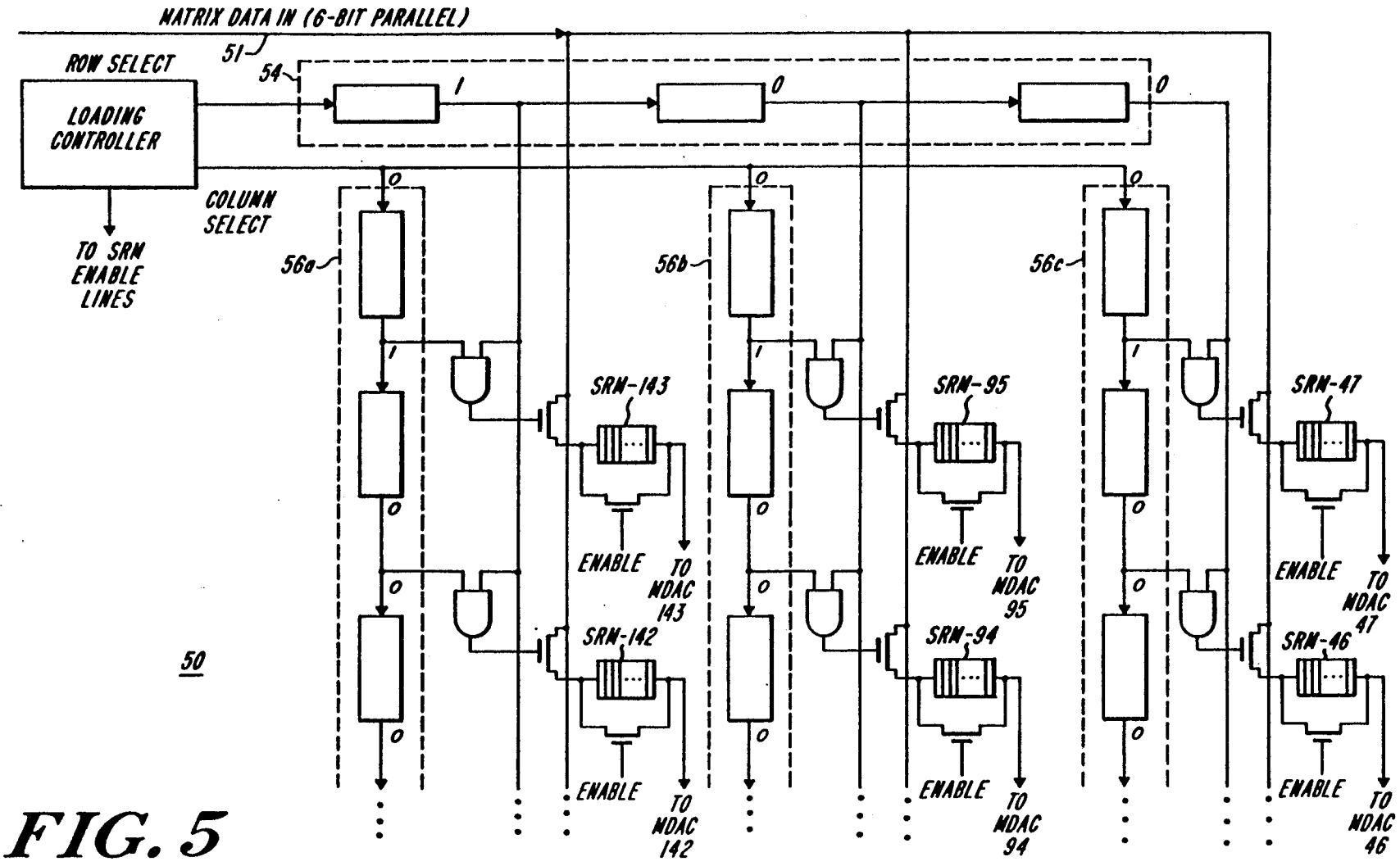
FIG. 5 shows in schematic form an exemplary data loading network for the vector-matrix product network of FIG. 4.

In the present embodiment, each of memories SRM-0 through SRM-143 is a 14 stage 6-bit CCD shift register stack, but in other forms of the invention, different types of shift registers may be used, such as CMOS. The preferred form for the matrix loading networks 34, 36 and 38 is the network 50 shown in FIG. 5. Network 50 includes an input matrix data but 51, a loading controller 52, and row pointer digital shift register 54, and three column pointer digital shift registers **56*a*, 56*b* and 56*c*, and associated digital and analog control gates. In FIG. 5, each of shift register memories SRM-0 through SRM-143** is shown with an associated, selectively operable FET feedback loop.

With this configuration, while the 144 6-bit matrix (weight) data are applied in succession to the matrix data bus at a loading clock rate, the loading controller 52 propagates a logic signal (e.g. binary "1") through the succession of stages of shift register 54 at a row select clock rate 1/48 times the loading clock rate, and propagates a logic signal the succession of stages of shift registers **56*a*, 56*b* and 56*c* at the loading clock rate. The coincidence of these logic signals at the respective AND gates of FIG. 5 initiate the loading of the proper matrix data word from bus 51 to the lowest stage of the shift register stack coupled by the FET to the AND gate words. Thus, controller 52 selectively addresses each of memories SRM-0 through SRM-143** and establish both loading of those memories and shifting of the loaded data in circulating (re-fresh) manner, whereby each of the 14 sets of stored matrix data values may be applied in parallel to the 6-bit digital weight (w) inputs of the 144 associated MDAC's.

Alternatively, each of the loading networks 34, 36 and 38 may be a charge coupled 144×6 bit shift register which receives 14 successive sets of 48 6-bit words in serial, wherein, upon receipt, each set is loaded to the input (bottom of the stack) register in the respective shift register memories SRM-0 through SRM-143, and shifted from stage-to-stage until all 14 sets are stored in the respective shift register memories.

In operation, after the 144 analog inputs $x_i$ and the 144×14 weights $w_{ij}$ are loaded into the processor 10, the each of the 14 sets of 144 6-bit words from the CCD digital SRM memories are sequentially applied to the MDAC's. After a first clock period, the total summed charge from all the MDAC's at summer 40 is $$\sum_{i=0}^{143} w_{i0}x_i,$$

i.e., the processor 10 computes the first output of the first layer, $u_0$. After the second clock period, the total summed charge is $$\sum_{i=0}^{143} w_{i1}x_i,$$

that is, $u_1$, the second layer. This operation repeats continuously until after 14 clock periods, the summed charge is $$\sum_{i=0}^{143} w_{i13}x_i,$$

that is, $u_{13}$. Depending upon user requirements for subsequent processing, the maximum of these values can then be selected and enhanced. The connection weights corresponding to the maximum output node can be adapted according to learning rules when operated in conjunction with additional networks.

Thus, as illustrated, the processor 10 has 144 inputs and 14 outputs, 2016 programmable connections, which are coupled together by summer 40 in FIG. 4. It is principally the use of the shift register format for storing the multiple layers of the $w_{ij}$ weights which provides the operating advantages of the present invention over that disclosed in the U.S. Pat. No. 4,464,726 and other prior art vector matrix product systems. With the invention, there is no need to successively address the matrix memory and extract (the weights), but rather the shift register memory may readily the shifted to apply the stored values (in either a refresh or non-refresh configuration). In order to make the processor 10 a generic processor the 144 inputs are loaded and stored in three CCD shift registers each 48 stages long. The processor, as illustrated, can be used to perform the most common neural network computation, the weighted sum of 144 analog inputs, where the weights are programmable. The processor 10 can also be used as a 1D correlator to compute the correlation of a 144 -element input vector with 14 different programmable reference functions. By reconfiguring processor 20, for example, by placement of selection switches at the output of processor 10, that network can implement a 2D matched filter to compute the spatial filtering of a 2D image with 14 different 3×48 programmable spatial templates. Other applications may also be established.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A charge domain vector-matrix product network for generating the signals representative of the product of an N-element vector and an N×K element matrix comprising:

A. a charge coupled device (CCD) N-stage tapped delay line, including:

means for establishing a succession of N charge packets therein in response to a succession of N applied input signals, each of said packets having a magnitude corresponding to one of the elements of said vector.

means for shifting said charge packets from stage-to-stage along said delay line, and N floating gate sensing electrodes, each of said electrodes overlying one of said stages and being adapted to provide a potential thereon representative of the magnitude of a charge package currently within its underlying stage, B. an N×K M-bit digital parallel shift register memory device adapted for storing N×K M-bit words, each of said words being representative of the value of a corresponding element of said matrix, wherein said shift register memory device includes K stages in a stack configuration, each stage including means for storing N M-bit words, and including means responsive to an applied shift signal for selectively shifting said stored words from stage-to-stage from an input stage to an output stage in said stack, C. N M-bit charge domain digital-analog multipliers, each of said multipliers including means for generating a charge packet therein having a magnitude proportional to the product of a potential applied to an analog input port thereof and an M-bit digital signal applied to a digital input port thereof, wherein the analog input port of each of said multipliers is coupled to an associated sensing electrode of said delay line, and the digital input port of each of said multipliers is coupled to an associated M-bit portion of said output stage said shift register memory device, and D. a controller for successively applying in parallel N words from said output stage of said shift register memory device to the respective digital input ports of said multipliers, where each set of N words includes the words representative of the values of one of the rows of said matrix, said controller including means for generating said shift signals and for applying said shift signals to said shift register memory device whereby said N words are shifted from stage to stage therein, E. a charge summing device operative for each set of N words applied to said multipliers, including means for generating in succession an output charge packet for each of said sets, each output charge packet having a magnitude proportional to the sum of the magnitude of the charge packets generated by said multipliers for said set, wherein the magnitudes the respective output charge packets correspond to the respective elements of said vector-matrix product.

2. A network according to claim 1 further comprising re-fresh means for coupling said input and output stages of said shift register memory device whereby said stored words are recirculated therein in response to said shift signals.

3. A network according to claim 1 further comprising a loading network for said shift register memory device, said loading network including a charge coupled device (CCD) N×M-bit shift register, including means for storing a succession of N M-bit words in successive stages of said shift register, and including means for loading the bits of said stored words into associated locations in the input stage of said stack of said shift register storage device.

4. A network according to claim 1 further comprising a loading network for said shift register memory device, said loading network including column pointer digital shift register and a row pointer digital shift register and associated gates and means for selectively loading data to said input stage of said stack of said shift register storage device.

5. A network according to claim 1 wherein said digital parallel shift memory is a charge domain device.

* * * * *

UNITED STATES PATENT AND TRADEMARK OFFICE

CERTIFICATE OF CORRECTION

PATENT NO. : 5,089,983

DATED : February 18, 1992

INVENTOR(S) : Alice M. Chiang

It is certified that error appears in the above-identified patent and that said Letters Patent is hereby corrected as shown below:

Column 1, line 5

-- This invention was made with Government support under Contract Number F19628-85-C-0002 awarded by the U.S. Air Force. The Government has certain rights in the invention." --

Signed and Sealed this

Seventh Day of December, 1993

*Attest:*

Bruce Lehman

BRUCE LEHMAN

*Attesting Officer*

*Commissioner of Patents and Trademarks*